US011565912B2

(12) United States Patent
Pelto-Huikko et al.

(10) Patent No.: US 11,565,912 B2
(45) **Date of Patent: *Jan. 31, 2023**

(54) ROPE FOR A HOISTING DEVICE, ELEVATOR AND USE

(71) Applicant: KONE CORPORATION, Helsinki (FI)

(72) Inventors: Raimo Pelto-Huikko, Vantaa (FI); Petteri Valjus, Helsinki (FI); Juha Honkanen, Joensuu (FI); Kim Sjödahl, Joensuu (FI)

(73) Assignee: KONE CORPORATION, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 17/039,315

(22) Filed: Sep. 30, 2020

(65) Prior Publication Data

US 2021/0009382 A1 Jan. 14, 2021

Related U.S. Application Data

(63) Continuation of application No. 15/796,360, filed on Oct. 27, 2017, now Pat. No. 10,843,900, which is a (Continued)

(30) Foreign Application Priority Data

Jan. 18, 2008 (FI) ..... 20080045
Sep. 25, 2008 (FI) ..... 20080538

(51) Int. Cl.
*B66B 7/06* (2006.01)
*D07B 1/04* (2006.01)

(Continued)

(52) U.S. Cl.
CPC ..... *B66B 7/062* (2013.01); *D07B 1/04* (2013.01); *B66B 7/12* (2013.01); *D07B 1/145* (2013.01);

(Continued)

(58) Field of Classification Search
CPC ..... B66B 7/06; B66B 7/062
See application file for complete search history.

(56) References Cited

U.S. PATENT DOCUMENTS 1,164,115 A 12/1915 Pearson
2,107,013 A 2/1938 Morgan (Continued)

FOREIGN PATENT DOCUMENTS

AU 2468771 A 7/1972
CN 202670972 U * 1/2013

(Continued)

OTHER PUBLICATIONS

Machine Translation of CN 202670972 to Bao.*

(Continued)

*Primary Examiner* — Diem M Tran
(74) *Attorney, Agent, or Firm* — Birch, Stewart, Kolasch & Birch, LLP

(57) ABSTRACT

A hoisting device rope has a width larger than a thickness thereof in a transverse direction of the rope. The rope includes a load-bearing part made of a composite material, the composite material including non-metallic reinforcing fibers, which include carbon fiber or glass fiber, in a polymer matrix. An elevator includes a drive sheave, an elevator car and a rope system for moving the elevator car by means of the drive sheave. The rope system includes at least one rope that has a width that is larger than a thickness thereof in a transverse direction of the rope. The rope includes a load- (Continued)

bearing part made of a composite material. The composite material includes reinforcing fibers in a polymer matrix.

30 Claims, 6 Drawing Sheets

Related U.S. Application Data continuation of application No. 12/838,156, filed on Jul. 16, 2010, now Pat. No. 9,828,214, which is a continuation of application No. PCT/FI2009/000018, filed on Jan. 15, 2009.

(51) Int. Cl.
*B66B 7/12* (2006.01)
*D07B 1/22* (2006.01)
*D07B 1/14* (2006.01)

(52) U.S. Cl.
CPC ..... *D07B 1/22* (2013.01); *D07B 2201/201* (2013.01); *D07B 2201/2033* (2013.01); *D07B 2201/2078* (2013.01); *D07B 2201/2087* (2013.01); *D07B 2205/206* (2013.01); *D07B 2205/2039* (2013.01); *D07B 2205/2057* (2013.01); *D07B 2205/3003* (2013.01); *D07B 2205/3007* (2013.01); *D07B 2501/2007* (2013.01); *Y10T 428/237* (2015.01); *Y10T 428/249945* (2015.04); *Y10T 428/249946* (2015.04)

(56) References Cited

U.S. PATENT DOCUMENTS

| | | | | |
|---|---|---|---|---|
| 2,526,324 | A | 10/1950 | Bloomfield | |
| 4,041,789 | A | 8/1977 | Hoback | |
| 4,563,391 | A | 1/1986 | Tanner et al. | |
| 5,080,175 | A | 1/1992 | Williams | |
| 5,127,783 | A | 7/1992 | Moghe et al. | |
| 5,348,084 | A | 9/1994 | Fay et al. | |
| 5,753,369 | A | 5/1998 | Kawashima et al. | |
| 6,138,799 | A | 10/2000 | Schröder-Brumloop et al. | |
| 6,295,799 | B1 | 10/2001 | Baranda | |
| 6,364,063 | B1 | 4/2002 | Aulanko et al. | |
| 6,386,324 | B1 | 5/2002 | Baranda et al. | |
| 6,595,883 | B1 | 7/2003 | Breed et al. | |
| 6,742,627 | B2 | 6/2004 | Drabot et al. | |
| 6,742,769 | B2 | 6/2004 | Baranda et al. | |
| 6,983,826 | B2 | 1/2006 | Wake et al. | |
| 7,926,649 | B2 | 4/2011 | Göser | |
| 10,689,230 | B2 | 6/2020 | Kuczek et al. | |
| 2001/0039226 | A1 | 11/2001 | Ito | |
| 2002/0000347 | A1* | 1/2002 | Baranda et al. | |
| 2003/0057031 | A1 | 3/2003 | Gottlieb et al. | |
| 2003/0121729 | A1* | 7/2003 | Heinz et al. | |
| 2004/0045772 | A1 | 3/2004 | Spiess et al. | |
| 2004/0083707 | A1 | 5/2004 | Eichhorn et al. | |
| 2004/0110441 | A1 | 6/2004 | Parrini | |
| 2006/0086415 | A1 | 4/2006 | Eichhorn | |
| 2007/0137163 | A1 | 6/2007 | Hess | |
| 2008/0003430 | A1 | 1/2008 | Wilson et al. | |
| 2008/0051240 | A1 | 2/2008 | Goser | |
| 2008/0081721 | A1* | 4/2008 | Bissig | D07B 1/025 474/260 |
| 2008/0164051 | A1 | 7/2008 | Lee et al. | |
| 2008/0250631 | A1 | 10/2008 | Buckley | |
| 2010/0018810 | A1* | 1/2010 | Yumura | B66B 5/02 187/258 |
| 2014/0004298 | A1 | 1/2014 | Reif | |
| 2014/0224592 | A1 | 8/2014 | Valjus et al. | |
| 2015/0101888 | A1 | 4/2015 | Pelto-Huikko | |
| 2015/0122587 | A1 | 5/2015 | Valjus | |
| 2016/0083224 | A1 | 3/2016 | Kere et al. | |
| 2017/0043979 | A1 | 2/2017 | Kucharczyk et al. | |
| 2017/0066630 | A1 | 3/2017 | Gurvich et al. | |
| 2020/0122971 | A1 | 4/2020 | Hida et al. | |

FOREIGN PATENT DOCUMENTS

| | | | |
|---|---|---|---|
| CN | 105672009 | A | 6/2016 |
| DE | 8702678.3 | U1 | 6/1987 |
| DE | 3813338 | A1 | 11/1989 |
| DE | 60015771 | T2 | 3/2005 |
| EP | 1357073 | A1 | 10/2003 |
| EP | 1396458 | A2 | 3/2004 |
| EP | 1428927 | A1 | 6/2004 |
| EP | 1477449 | A1 | 11/2004 |
| EP | 1555233 | A | 7/2005 |
| EP | 1561719 | A1 | 8/2005 |
| EP | 1561719 | A1 * | 10/2005 |
| EP | 1640307 | A2 | 3/2006 |
| GB | 2162283 | A | 1/1986 |
| JP | 3-119188 | A | 5/1991 |
| JP | 9-324376 | A | 12/1997 |
| JP | 2002-505240 | A | 2/2002 |
| JP | 2004-1919 | A | 1/2004 |
| JP | 2004-115985 | A | 4/2004 |
| JP | 2004-155589 | A | 6/2004 |
| JP | 2004-218099 | A | 8/2004 |
| JP | 2006-193330 | A | 7/2006 |
| WO | WO 98/29326 | A1 | 7/1998 |
| WO | WO 01/28896 | A1 | 4/2001 |
| WO | WO 2006/000500 | A1 | 1/2006 |
| WO | WO-2007/050069 | A1 | 5/2007 |
| WO | WO 2009/026730 | A1 | 3/2009 |

OTHER PUBLICATIONS

Extended European seach report for Application No. 09702385.7 dated May 6, 2014.

Korean Office Action for Korean Application No. 10-2010-7016013, dated Dec. 22, 2014, with an English translation.

Mott, "Applied Strength of Materials," 4th Edition, Prentice Hall, Jul. 2001, pp. 69-79 (15 pages total).

Roylance, "Introduction to Composite Materials," M.I.T., Deptarment of Materials Science and Engineering, Mar. 24, 2000, pp. 1-7.

"Overview of materials for Polyester (Thermoset)—Rigid," Database MatWeb (Online), Jan. 1, 1996, 3 pages total.

"Overview of materials for Vinyl Ester Sheet Molding Compound," Database MatWeb (Online), Jan. 1, 1996, 3 pages total.

European Communication of a Notice of Opposition for European Application No. 09702385.7, dated Apr. 22, 2022.

Gündüz et al., "Mechanical Properties of Unsaturated Polyester-Isocyanate Hyrid Polymer Network and Its E-Glass Fiber-reinforced Composite," Journal of Composite Materials, vol. 39, No. 17, Sep. 2005, pp. 1577-1589 (13 pages total).

Harper, "Modern Plastics Handbook," Technology Seminars, Inc., McGraw-Hill, 1999, 96 pages total.

Shelley, "Epoxy resins," Polymer Data Handbook, Oxford University Press, 1999, pp. 90-96 (7 pages total).

Viers, "Kevlar," Polymer Data Handbook, Oxford University Press, 1999, pp. 140-157, (18 pages total).

* cited by examiner

ROPE FOR A HOISTING DEVICE, ELEVATOR AND USE

CROSS-REFERENCE TO RELATED APPLICATIONS

This application is a Continuation of U.S. application Ser. No. 15/796,360 filed on Oct. 27, 2017, which is a Continuation of U.S. application Ser. No. 12/838,156 filed on Jul. 16, 2010 (U.S. Pat. No. 9,828,214 issued on Nov. 28, 2017), which is a Continuation of PCT/FI2009/000018 filed on Jan. 15, 2009, and to which priority is claimed under 35 U.S.C. § 120. PCT/FI2009/000018 claims priority under 35 U.S.C. § 119(a) on Patent Application No. FI 20080045 and FI 20080538, filed in Finland on Jan. 18, 2008 and Sep. 25, 2008, respectively. The entirety of each of the above-identified applications is incorporated herein by reference.

BACKGROUND OF THE INVENTION

1. Field of the Invention

The present invention relates to a hoisting device rope, to an elevator as and to a method of using the hoisting device rope and the elevator.

2. Description of Background Art

Elevator ropes are generally made by braiding from metallic wires or strands and have a substantially round cross-sectional shape. A problem with metallic ropes is, due to the material properties of metal, that they have a high weight and a large thickness in relation to their tensile strength and tensile stiffness. There are also background-art belt-shaped elevator ropes which have a width larger than their thickness. Previously known are, e.g. solutions in which the load-bearing part of a belt-like elevator hoisting rope consists of metal wires coated with a soft material that protects the wires and increases the friction between the belt and the drive sheave. Due to the metal wires, such a solution involves the problem of high weight. On the other hand, a solution described in the specification of EP 1640307 A2 proposes the use of aramid braids as the load-bearing part. A problem with aramid material is mediocre tensile stiffness and tensile strength. Moreover, the behavior of aramid at high temperatures is problematic and constitutes a safety hazard. A further problem with solutions based on a braided construction is that the braiding reduces the stiffness and strength of the rope. In addition, the separate fibers of the braiding can undergo movement relative to each other in connection with bending of the rope, the wear of the fibers being thus increased. Tensile stiffness and thermal stability are also a problem in the solution proposed by the specification of WO 1998/029326, in which the load-bearing part used is an aramid fabric surrounded by polyurethane.

SUMMARY OF THE INVENTION

An object of the present invention is, among others, to eliminate the above-mentioned drawbacks of the background-art solutions. A specific object of the invention is to improve the roping of a hoisting device, particularly a passenger elevator.

The aim of the invention is to produce one or more the following advantages, among others:

- A rope that is light in weight and has a high tensile strength and tensile stiffness relative to its weight is achieved.
- A rope having an improved thermal stability against high temperatures is achieved.
- A rope having a high thermal conductivity combined with a high operating temperature is achieved.
- A rope that has a simple belt-like construction and is simple to manufacture is achieved.
- A rope that comprises one straight load-bearing part or a plurality of parallel straight load-bearing parts is achieved, an advantageous behavior at bending being thus obtained.
- An elevator having low-weight ropes is achieved.
- The load-bearing capacity of the sling and counterweight can be reduced.
- An elevator and an elevator rope are achieved in which the masses and axle loads to be moved and accelerated are reduced.
- An elevator in which the hoisting ropes have a low weight vs. rope tension is achieved.
- An elevator and a rope are achieved wherein the amplitude of transverse vibration of the rope is reduced and its vibration frequency increased.
- An elevator is achieved in which so-called reverse-bending roping has a reduced effect towards shortening service life.
- An elevator and a rope with no discontinuity or cyclic properties of the rope are achieved, the elevator rope being therefore noiseless and advantageous in respect of vibration.
- A rope is achieved that has a good creep resistance, because it has a straight construction and its geometry remains substantially constant at bending.
- A rope having low internal wear is achieved.
- A rope having a good resistance to high temperature and a good thermal conductivity is achieved.
- A rope having a good resistance to shear is achieved.
- An elevator having a safe roping is achieved.
- A high-rise elevator is achieved whose energy consumption is lower than that of earlier elevators.

In elevator systems, the rope of the invention can be used as a safe means of supporting and/or moving an elevator car, a counterweight or both. The rope of the invention is applicable for use both in elevators with counterweight and in elevators without counterweight. In addition, it can also be used in conjunction with other devices, e.g. as a crane hoisting rope. The low weight of the rope provides an advantage especially in acceleration situations, because the energy required by changes in the speed of the rope depends on its mass. The low weight further provides an advantage in rope systems requiring separate compensating ropes, because the need for compensating ropes is reduced or eliminated altogether. The low weight also allows easier handling of the ropes.

The hoisting rope for a hoisting device according to the invention are presented in the appended claims. Inventive embodiments are also presented in the description part and drawings of the present application. The inventive content disclosed in the application can also be defined in other ways than is done in the claims below. The inventive content may also consist of several separate inventions, especially if the invention is considered in light of explicit or implicit subtasks or with respect to advantages or sets of advantages achieved. In this case, some of the attributes contained in the claims below may be superfluous from the point of view of separate inventive concepts. The features of different embodiments of the invention can be applied in connection with other embodiments within the scope of the basic inventive concept.

According to the invention, the width of the hoisting rope for a hoisting device is larger than its thickness in a transverse direction of the rope. The rope comprises a load-bearing part made of a composite material, which composite material comprises non-metallic reinforcing fibers in a polymer matrix, said reinforcing fibers consisting of carbon fiber or glass fiber. The structure and choice of material make it possible to achieve low-weight hoisting ropes having a thin construction in the bending direction, a good tensile stiffness and tensile strength and an improved thermal stability. In addition, the rope structure remains substantially unchanged at bending, which contributes towards a long service life.

In an embodiment of the invention, the aforesaid reinforcing fibers are oriented in a longitudinal direction of the rope, i.e. in a direction parallel to the longitudinal direction of the rope. Thus, forces are distributed on the fibers in the direction of the tensile force, and additionally the straight fibers behave at bending in a more advantageous manner than do fibers arranged e.g. in a spiral or crosswise pattern. The load-bearing part, consisting of straight fibers bound together by a polymer matrix to form an integral element, retains its shape and structure well at bending.

In an embodiment of the invention, individual fibers are homogeneously distributed in the aforesaid matrix. In other words, the reinforcing fibers are substantially uniformly distributed in the said load-bearing part.

In an embodiment of the invention, said reinforcing fibers are bound together as an integral load-bearing part by said polymer matrix.

In an embodiment of the invention, said reinforcing fibers are continuous fibers oriented in the lengthwise direction of the rope and preferably extending throughout the length of the rope.

In an embodiment of the invention, said load-bearing part consists of straight reinforcing fibers parallel to the lengthwise direction of the rope and bound together by a polymer matrix to form an integral element.

In an embodiment of the invention, substantially all of the reinforcing fibers of said load-bearing part are oriented in the lengthwise direction of the rope.

In an embodiment of the invention, said load-bearing part is an integral elongated body. In other words, the structures forming the load-bearing part are in mutual contact. The fibers are bound in the matrix preferably by a chemical bond, preferably by hydrogen bonding and/or covalent bonding.

In an embodiment of the invention, the structure of the rope continues as a substantially uniform structure throughout the length of the rope.

In an embodiment of the invention, the structure of the load-bearing part continues as a substantially uniform structure throughout the length of the rope.

In an embodiment of the invention, substantially all of the reinforcing fibers of said load-bearing part extend in the lengthwise direction of the rope. Thus, the reinforcing fibers extending in the longitudinal direction of the rope can be adapted to carry most of the load.

In an embodiment of the invention, the polymer matrix of the rope consists of non-elastomeric material. Thus, a structure is achieved in which the matrix provides a substantial support for the reinforcing fibers. The advantages include a longer service life and the possibility of employing smaller bending radii.

In an embodiment of the invention, the polymer matrix comprises epoxy, polyester, phenolic plastic or vinyl ester. These hard materials together with aforesaid reinforcing fibers lead to an advantageous material combination that provides i.a. an advantageous behavior of the rope at bending.

In an embodiment of the invention, the load-bearing part is a stiff, unitary coherent elongated bar-shaped body which returns straight when free of external bending. For this reason also the rope behaves in this manner.

In an embodiment of the invention, the coefficient of elasticity (E) of the polymer matrix is greater than 2 GPa, preferably greater than 2.5 GPa, more preferably in the range of 2.5-10 GPa, and most preferably in the range of 2.5-3.5 GPa.

In an embodiment of the invention, over 50% of the cross-sectional square area of the load-bearing part consists of said reinforcing fiber, preferably so that 50%-80% consists of said reinforcing fiber, more preferably so that 55%-70% consists of said reinforcing fiber, and most preferably so that about 60% of said area consists of reinforcing fiber and about 40% of matrix material. This allows advantageous strength properties to be achieved while the amount of matrix material is still sufficient to adequately surround the fibers bound together by it.

In an embodiment of the invention, the reinforcing fibers together with the matrix material form an integral load-bearing part, inside which substantially no chafing relative motion between fibers or between fibers and matrix takes place when the rope is being bent. The advantages include a long service life of the rope and advantageous behavior at bending.

In an embodiment of the invention, the load-bearing part(s) covers/cover a main proportion of the cross-section of the rope. Thus, a main proportion of the rope structure participates in supporting the load. The composite material can also be easily molded into such a form.

In an embodiment of the invention, the width of the load-bearing part of the rope is larger than its thickness in a transverse direction of the rope. The rope can therefore withstand bending with a small radius.

In an embodiment of the invention, the rope comprises a number of aforesaid load-bearing parts side by side. In this way, the liability to failure of the composite part can be reduced, because the width/thickness ratio of the rope can be increased without increasing the width/thickness ratio of an individual composite part too much.

In an embodiment of the invention, the reinforcing fibers consist of carbon fiber. In this way, a light construction and a good tensile stiffness and tensile strength as well as good thermal properties are achieved.

In an embodiment of the invention, the rope additionally comprises outside the composite part at least one metallic element, such as a wire, lath or metallic grid. This renders the belt less liable to damage by shear.

In an embodiment of the invention, the aforesaid polymer matrix consists of epoxy.

In an embodiment of the invention, the load-bearing part is surrounded by a polymer layer. The belt surface can thus be protected against mechanical wear and humidity, among other things. This also allows the frictional coefficient of the rope to be adjusted to a sufficient value. The polymer layer preferably consists of elastomer, most preferably high-friction elastomer, such as e.g. polyurethane.

In an embodiment of the invention, the load-bearing part consists of the aforesaid polymer matrix, of the reinforcing fibers bound together by the polymer matrix, and of a coating that may be provided around the fibers, and of auxiliary materials possibly comprised within the polymer matrix.

According to the invention, the elevator comprises a drive sheave, an elevator car and a rope system for moving the elevator car by means of the drive sheave, said rope system comprising at least one rope whose width is larger than its thickness in a transverse direction of the rope. The rope comprises a load-bearing part made of a composite material comprising reinforcing fibers in a polymer matrix. The said reinforcing fibers consist of carbon fiber or glass fiber. This provides the advantage that the elevator ropes are low-weight ropes and advantageous in respect of heat resistance. An energy efficient elevator is also thus achieved. An elevator can thus be implemented even without using any compensating ropes at all. If desirable, the elevator can be implemented using a small-diameter drive sheave. The elevator is also safe, reliable and simple and has a long service life.

In an embodiment of the invention, said elevator rope is a hoisting device rope as described above.

In an embodiment of the invention, the elevator has been arranged to move the elevator car and counterweight by means of said rope. The elevator rope is preferably connected to the counterweight and elevator car with a 1:1 hoisting ratio, but could alternatively be connected with a 2:1 hoisting ratio.

In an embodiment of the invention, the elevator comprises a first belt-like rope or rope portion placed against a pulley, preferably the drive sheave, and a second belt-like rope or rope portion placed against the first rope or rope portion, and that the said ropes or rope portions are fitted on the circumference of the drive sheave one over the other as seen from the direction of the bending radius. The ropes are thus set compactly on the pulley, allowing a small pulley to be used.

In an embodiment of the invention, the elevator comprises a number of ropes fitted side by side and one over the other against the circumference of the drive sheave. The ropes are thus set compactly on the pulley.

In an embodiment of the invention, the first rope or rope portion is connected to the second rope or rope portion placed against it by a chain, rope, belt or equivalent passed around a diverting pulley mounted on the elevator car and/or counterweight. This allows compensation of the speed difference between the hoisting ropes moving at different speeds.

In an embodiment of the invention, the belt-like rope passes around a first diverting pulley, on which the rope is bent in a first bending direction, after which the rope passes around a second diverting pulley, on which the rope is bent in a second bending direction, this second bending direction being substantially opposite to the first bending direction. The rope span is thus freely adjustable, because changes in bending direction are less detrimental to a belt whose structure does not undergo any substantial change at bending. The properties of carbon fiber also contribute to the same effect.

In an embodiment of the invention, the elevator has been implemented without compensating ropes. This is particularly advantageous in an elevator according to the invention in which the rope used in the rope system is of a design as defined above. The advantages include energy efficiency and a simple elevator construction. In this case it is preferable to provide the counterweight with bounce-limiting means.

In an embodiment of the invention, the elevator is an elevator with counterweight, having a hoisting height of over 30 meters, preferably 30-80 meters, most preferably 40-80 meters, said elevator being implemented without compensating ropes. The elevator thus implemented is simpler than earlier elevators and yet energy efficient.

In an embodiment of the invention, the elevator has a hoisting height of over 75 meters, preferably over 100 meters, more preferably over 150 meters, most preferably over 250 meters. The advantages of the invention are apparent especially in elevators having a large hoisting height, because normally in elevators with a large hoisting height the mass of the hoisting ropes constitutes most of the total mass to be moved. Therefore, when provided with a rope according to the present invention, an elevator having a large hoisting height is considerably more energy efficient than earlier elevators. An elevator thus implemented is also technically simpler, more material efficient and cheaper to manufacture, because e.g. the masses to be braked have been reduced. The effects of this are reflected on most of the structural components of the elevator regarding dimensioning. The invention is well applicable for use as a high-rise elevator or a mega high-rise elevator.

In the use according to the invention, a hoisting device rope according to one of the above definitions is used as the hoisting rope of an elevator, especially a passenger elevator. One of the advantages is an improved energy efficiency of the elevator.

In an embodiment of the invention, a hoisting device rope according to one of the above definitions is used as the hoisting rope of an elevator according to one of the above definitions. The rope is particularly well applicable for use in high-rise elevators and/or to reduce the need for a compensating rope.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1A:
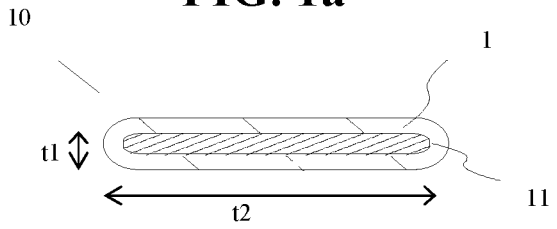
FIGS. 1*a*-1*m* are diagrammatic illustrations of the rope of the invention, each representing a different embodiment.

FIGS. 1*a*-1*m* present diagrams representing preferred cross-sections of hoisting ropes, preferably for a passenger elevator, according to different embodiments of the invention as seen from the lengthwise direction of the ropes. The rope (10, 20, 30, 40, 50, 60, 70, 80, 90, 100, 110, 120, 130) represented by FIGS. 1*a*-1*m* has a belt-like structure. In other words, the rope has, as measured in a first direction, which is perpendicular to the lengthwise direction of the rope, thickness t1 and, as measured in a second direction, which is perpendicular to the lengthwise direction of the rope and to the aforesaid first direction, width t2, this width t2 being substantially larger than the thickness t1. The width of the rope is thus substantially larger than its thickness. Moreover, the rope has preferably, but not necessarily, at least one, preferably two broad and substantially even surfaces. The broad surface can be efficiently used as a force-transmitting surface utilizing friction or a positive contact, because in this way a large contact surface is obtained. The broad surface need not be completely even, but it may be provided with grooves or protrusions or it may have a curved shape. The rope preferably has a substantially uniform structure throughout its length, but not necessarily. If desirable, the cross-section can be arranged to be cyclically changing, e.g. as a cogged structure. The rope (10, 20, 30, 40, 50, 60, 70, 80, 90, 100, 110, 120) comprises a load-bearing part (11, 21, 31, 41, 51, 61, 71, 81, 91, 101, 111, 121), which is made of a non-metallic fiber composite comprising carbon fibers or glass fibers, preferably carbon fibers, in a polymer matrix. The load-bearing part (or possibly load-bearing parts) and its fibers are oriented in the lengthwise direction of the rope, which is why the rope retains its structure at bending. Individual fibers are thus substantially oriented in the longitudinal direction of the rope. The fibers are thus oriented in the direction of the force when a tensile force is acting on the rope. The aforesaid reinforcing fibers are bound together by the aforesaid polymer matrix to form an integral load-bearing part. Thus, said load-bearing part (11, 21, 31, 41, 51, 61, 71, 81, 91, 101, 111, 121) is a unitary coherent elongated bar-shaped body. Said reinforcing fibers are long continuous fibers preferably oriented in the lengthwise direction of the rope and preferably extending throughout the length of the rope. Preferably as many of the fibers, most preferably substantially all of the reinforcing fibers of said load-bearing part are oriented in the lengthwise direction of the rope. In other words, preferably the reinforcing fibers are substantially mutually non-entangled. Thus, a load-bearing part is achieved whose cross-sectional structure continues as unchanged as possible throughout the entire length of the rope. Said reinforcing fibers are distributed as evenly as possible in the load-bearing part to ensure that the load-bearing part is as homogeneous as possible in the transverse direction of the rope. The bending direction of the ropes shown in FIGS. 1*a*-1*m* would be up or down in the figures.

The rope 10 presented in FIG. 1*a* comprises a load-bearing composite part 1*l* having a rectangular shape in cross-section and surrounded by a polymer layer 1. Alternatively, the rope can be formed without a polymer layer 1.

Figure 1B:
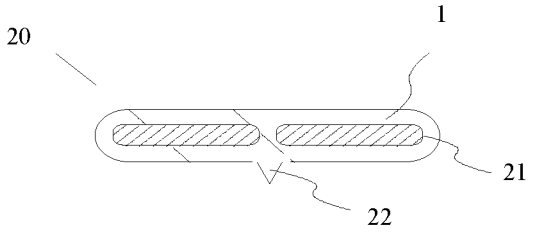
Figure 1C:
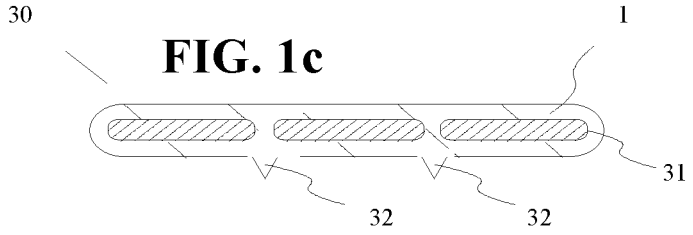

The rope 20 presented in FIG. 1*b* comprises two load-bearing composite parts 21 of rectangular cross-section placed side by side and surrounded by a polymer layer 1. The polymer layer 1 comprises a protrusion 22 for guiding the rope, located halfway between the edges of a broad side of the rope 10, at the middle of the area between the parts 21. The rope may also have more than two composite parts placed side by side in this manner, as illustrated in FIG. 1*c*.

Figure 1D:
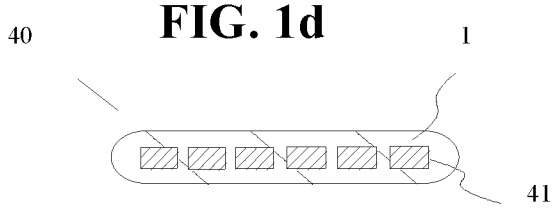

The rope 40 presented in FIG. 1*d* comprises a number of load-bearing composite parts 41 of rectangular cross-sectional shape placed side by side in the widthwise direction of the belt and surrounded by a polymer layer 1. The load-bearing parts shown in the figure are somewhat larger in width than in thickness. Alternatively, they could be implemented as having a substantially square cross-sectional shape.

Figure 1E:
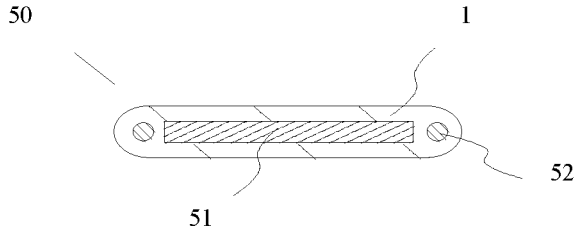
Figure 1F:
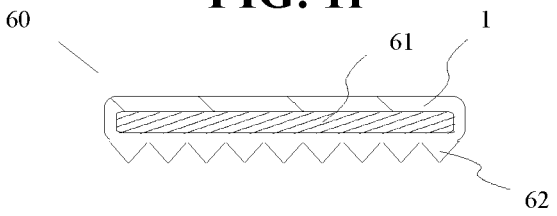

The rope 50 presented in FIG. 1*e* comprises a load-bearing composite part 51 of rectangular cross-sectional shape, with a wire 52 placed on either side of it, the composite part 51 and the wire 52 being surrounded by a polymer layer 1. The wire 52 may be a rope or strand and is preferably made of shear-resistant material, such as metal. The wire is preferably at the same distance from the rope surface as the composite part 51 and preferably, but not necessarily, spaced apart from the composite part. However, the protective metallic part could also be in a different form, e.g. a metallic lath or grid which runs alongside the length of the composite part.

The rope 60 presented in Figure if comprises a load-bearing composite part 61 of rectangular cross-sectional shape surrounded by a polymer layer 1. Formed on a surface of the rope 60 is a wedging surface consisting of a plurality of wedge-shaped protrusions 62, which preferably form a continuous part of the polymer layer 1.

Figure 1G:
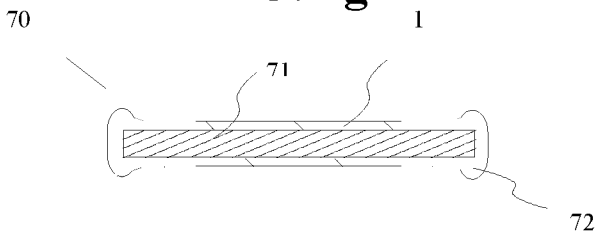

The rope 70 presented in FIG. 1*g* comprises a load-bearing composite part 71 of rectangular cross-sectional shape surrounded by a polymer layer 1. The edges of the rope comprise swelled portions 72, which preferably form part of the polymer layer 1. The swelled portions provide the advantage of guarding the edges of the composite part, e.g. against fraying.

Figure 1H:
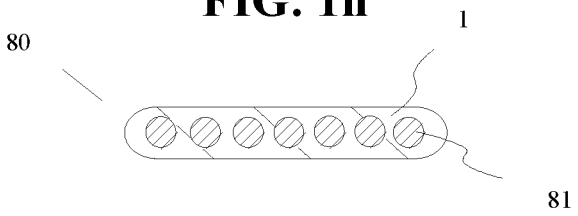

The rope 80 presented in FIG. 1*h* comprises a number of load-bearing composite parts 81 of round cross-section surrounded by a polymer layer 1.

Figure 1I:
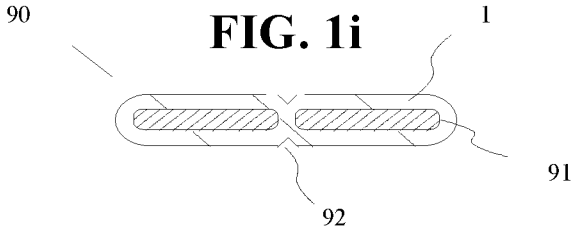
Figure 1J:
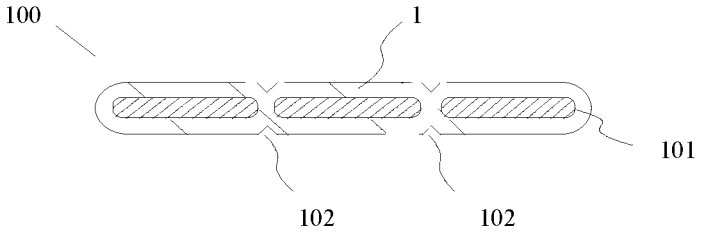

The rope 90 presented in FIG. 1*i* comprises two load-bearing parts 91 of square cross-section placed side by side and surrounded by a polymer layer 1. The polymer layer 1 comprises a groove 92 in the region between parts 91 to render the rope more pliable, so that the rope will readily conform, e.g. to curved surfaces. Alternatively, the grooves can be used to guide the rope. The rope may also have more than two composite parts placed side by side in this manner as illustrated in FIG. 1*j*.

Figure 1K:
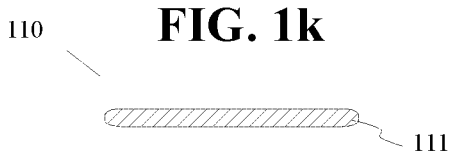

The rope 110 presented in FIG. 1*k* comprises a load-bearing composite part 111 having a substantially square cross-sectional shape. The width of the load-bearing part 111 is larger than its thickness in a transverse direction of the rope. The rope 110 has been formed without using a polymer layer at all, unlike the embodiments described above, so the load-bearing part 111 covers the entire cross-section of the rope.

Figure 1L:
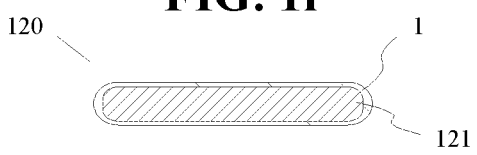

The rope 120 presented in FIG. 1*l* comprises a load-bearing composite part 121 of substantially rectangular cross-sectional shape having rounded corners. The load-bearing part 121 has a width larger than its thickness in a transverse direction of the rope and is covered by a thin polymer layer 1. The load-bearing part 121 covers a main proportion of the cross-section of the rope 120. The polymer layer 1 is very thin as compared to the thickness of the load-bearing part in the thickness-wise direction t1 of the rope.

Figure 1M:
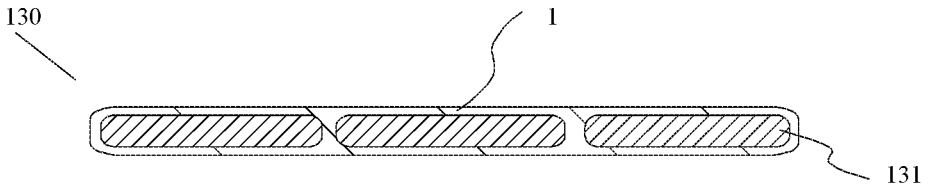

The rope 130 presented in FIG. 1*m* comprises mutually adjacent load-bearing composite parts 131 of substantially rectangular cross-sectional shape having rounded corners. The load-bearing part 131 has a width larger than its thickness in a transverse direction of the rope and is covered by a thin polymer layer 1. The load-bearing part 131 covers a main proportion of the cross-section of the rope 130. The polymer layer 1 is very thin as compared to the thickness of the load-bearing part in the thickness-wise direction t1 of the rope. The polymer layer 1 is preferably less than 1.5 mm in thickness, most preferably about 1 mm.

Each one of the above-described ropes comprises at least one integral load-bearing composite part (11, 21, 31, 41, 51, 61, 71, 81, 91, 101, 111, 121) containing synthetic reinforcing fibers embedded in a polymer matrix. The reinforcing fibers are most preferably continuous fibers. They are oriented substantially in the lengthwise direction of the rope, so that a tensile stress is automatically applied to the fibers in their lengthwise direction. The matrix surrounding the reinforcing fibers keeps the fibers in substantially unchanging positions relative to each other. Being slightly elastic, the matrix serves as a means of equalizing the distribution of the force applied to the fibers and reduces inter-fiber contacts and internal wear of the rope, thus increasing the service life of the rope. Eventual longitudinal inter-fiber motion consists in elastic shear exerted on the matrix, but the main effect occurring at bending consists in stretching of all materials of the composite part and not in relative motion between them. The reinforcing fibers most preferably consist of carbon fiber, permitting characteristics such as good tensile stiffness, low-weight structure and good thermal properties to be achieved. Alternatively, a reinforcement suited for some uses is glass fiber reinforcement, which provides inter alia a better electric insulation. In this case, the rope has a somewhat lower tensile stiffness, so it is possible to use small-diameter drive sheaves. The composite matrix, in which individual fibers are distributed as homogeneously as possible, most preferably consists of epoxy, which has a good adhesion to reinforcements and a good strength and behaves advantageously in combination with glass and carbon fiber. Alternatively, it is possible to use, e.g. polyester or vinyl ester. Most preferably the composite part (10, 20, 30, 40, 50, 60, 70, 80, 90, 100, 110, 120, 130) comprises about 60% carbon fiber and 40% epoxy. As stated above, the rope may comprise a polymer layer 1. The polymer layer 1 preferably consists of elastomer, most preferably high-friction elastomer, such as, e.g. polyurethane, so that the friction between the drive sheave and the rope will be sufficient for moving the rope.

The table below shows the advantageous properties of carbon fiber and glass fiber. They have good strength and stiffness properties while also having a good thermal resistance, which is important in elevators, because a poor thermal resistance may result in damage to the hoisting ropes or even in the ropes catching fire, which is a safety hazard. A good thermal conductivity contributes inter alia to the transmission of frictional heat, thereby reducing excessive heating of the drive sheave or accumulation of heat in the rope elements.

| | | Glass fiber | Carbon fiber | Aramid fiber |
|---|---|---|---|---|
| Density | $Kg/m^3$ | 2540 | 1820 | 1450 |
| Strength | $N/mm^2$ | 3600 | 4500 | 3620 |
| Stiffness | $N/mm^2$ | 75000 | 200000-600000 | 75000 . . . 120000 |
| Softening temperature | deg C. | 850 | >2000 | 450 . . . 500, carbonizing |
| Thermal conductivity | W/mK | 0.8 | 105 | 0.05 |

Figure 2:
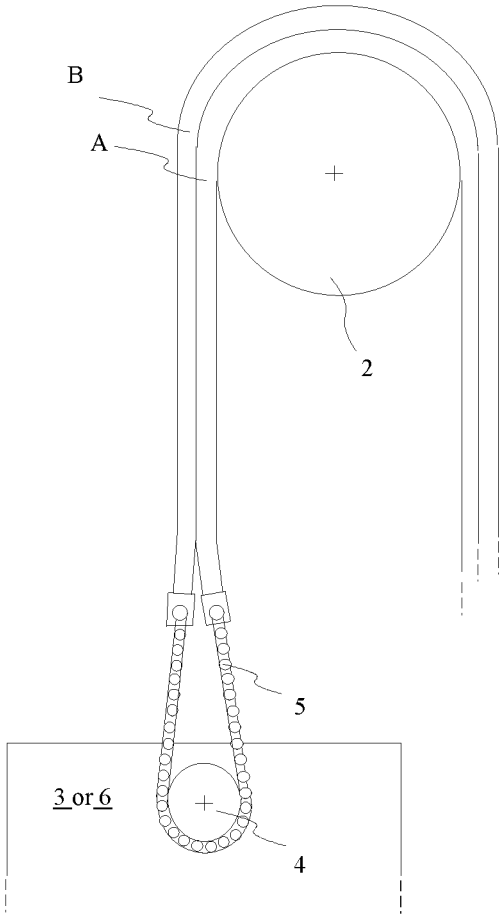
FIG. 2 is a diagrammatic representation of an embodiment of the elevator of the invention.
Figure 3:
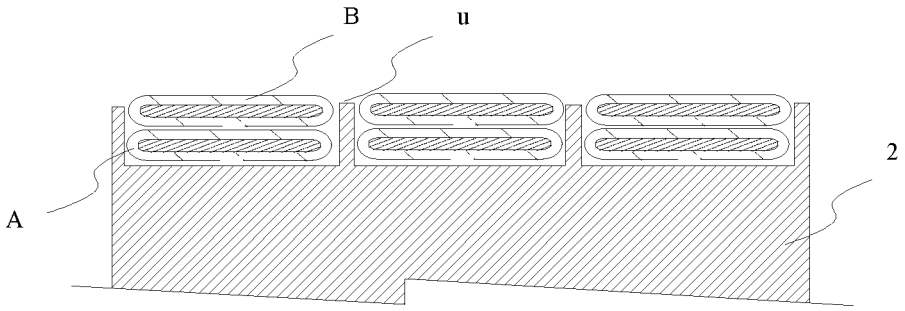
FIG. 3 represents a detail of the elevator in FIG. 2.

FIG. 2 represents an elevator according to an embodiment of the invention in which a belt-like rope is utilized. The ropes A and B are preferably, but not necessarily, implemented according to one of FIGS. 1*a*-1*m*. A number of belt-like ropes A and B passing around the drive sheave 2 are set one over the other against each other. The ropes A and B are of belt-like design and rope A is set against the drive sheave 2 and rope B is set against rope A, so that the thickness of each belt-like rope A and B in the direction of the center axis of the drive sheave 2 is larger than in the radial direction of the drive sheave 2. The ropes A and B moving at different radii have different speeds. The ropes A and B passing around a diverting pulley 4 mounted on the elevator car or counterweight 3 are connected together by a chain 5, which compensates the speed difference between the ropes A and B moving at different speeds. The chain is passed around a freely rotating diverting pulley 4, so that, if necessary, the rope can move around the diverting pulley at a speed corresponding to the speed difference between the ropes A and B placed against the drive sheave. This compensation can also be implemented in other ways than by using a chain. Instead of a chain, it is possible to use, e.g. a belt or rope. Alternatively, it is possible to omit the chain 5 and implement rope A and rope B depicted in the figure as a single continuous rope, which can be passed around the diverting pulley 4 and back up, so that a portion of the rope leans against another portion of the same rope leaning against the drive sheave. Ropes set one over the other can also be placed side by side on the drive sheave as illustrated in FIG. 3, thus allowing efficient space utilization. In addition, it is also possible to pass around the drive sheave more than two ropes one over the other.

FIG. 3 presents a detail of the elevator according to FIG. 2, depicted in the direction of section A-A. Supported on the drive sheave are a number of mutually superimposed ropes A and B disposed mutually adjacently, each set of said mutually superimposed ropes comprising a number of belt-like ropes A and B. In the figure, the mutually superimposed ropes are separated from the adjacent mutually superimposed ropes by a protrusion u provided on the surface of the drive sheave, said protrusion u preferably protruding from the surface of the drive sheave along the whole length of the circumference, so that the protrusion u guides the ropes. The mutually parallel protrusions u on the drive sheave 2 thus form between them groove-shaped guide surfaces for the ropes A and B. The protrusions u preferably have a height reaching at least up to the level of the midline of the material thickness of the last one B of the mutually superimposed ropes as seen in sequence starting from the surface of the drive sheave 2. If desirable, it is naturally also possible to implement the drive sheave in FIG. 3 without protrusions or with protrusions shaped differently. Of course, if desirable, the elevator described can also be implemented in such manner that there are no mutually adjacent ropes but only mutually superimposed ropes A,B on the drive sheave. Disposing the ropes in a mutually superimposed manner enables a compact construction and permits the use of a drive sheave having a shorter dimension as measured in the axial direction.

Figure 4:
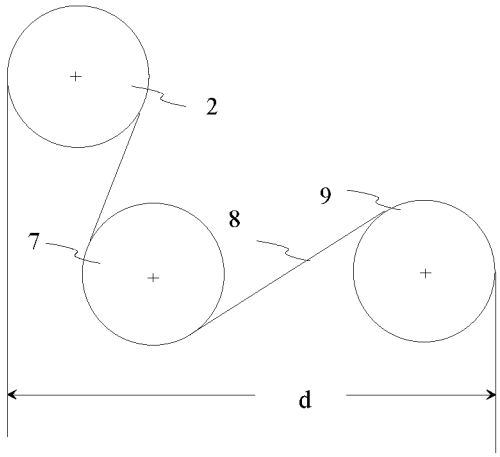
FIG. 4 is a diagrammatic representation of an embodiment of the elevator of the invention.

FIG. 4 represents the rope system of an elevator according to an embodiment of the invention, wherein the rope 8 has been arranged using a layout of reverse bending type, i.e. a layout where the bending direction varies as the rope is moving from pulley 2 to pulley 7 and further to pulley 9. In this case, the rope span d is freely adjustable, because the variation in bending direction is not detrimental when a rope according to the invention is used, for the rope is non-braided, retains its structure at bending and is thin in the bending direction. At the same time, the distance through which the rope remains in contact with the drive sheave may be over 180 degrees, which is advantageous in respect of friction. The figure only shows a view of the roping in the region of the diverting pulleys. From pulleys 2 and 9, the rope 8 may be passed according to a known technology to the elevator car and/or counterweight and/or to an anchorage in the elevator shaft. This may be implemented, e.g. in such manner that the rope continues from pulley 2 functioning as a drive sheave to the elevator car and from pulley 9 to the counterweight, or the other way round. In construction, the rope 8 is preferably one of those presented in FIGS. 1*a*-1*m*.

Figure 5:
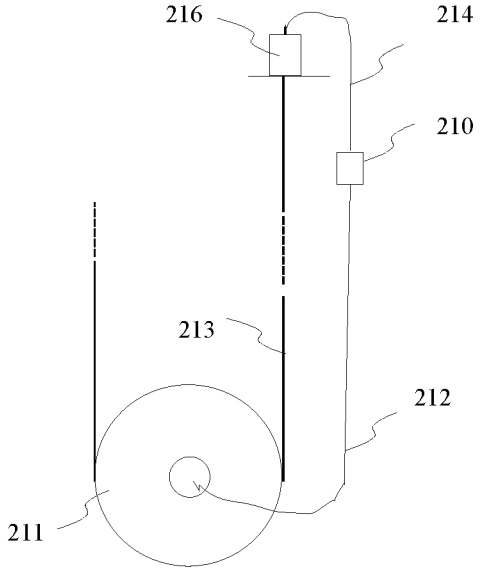
FIG. 5 is a diagrammatic representation of an embodiment of the elevator of the invention comprising a condition monitoring arrangement.

FIG. 5 is a diagrammatic representation of an embodiment of the elevator of the invention provided with a condition monitoring arrangement for monitoring the condition of the rope 213, particularly for monitoring the condition of the polymer coating surrounding the load-bearing part. The rope is preferably of a type as illustrated above in one of FIGS. 1*a*-1*m* and comprises an electrically conductive part, preferably a part containing carbon fiber. The condition monitoring arrangement comprises a condition monitoring device 210 connected to the end of the rope 213, to the load-bearing part of the rope 213 at a point near its anchorage 216, said part being electrically conductive. The arrangement further comprises a conductor 212 connected to an electrically conductive, preferably metallic diverting pulley 211 guiding the rope 213 and also to the condition monitoring device 210. The condition monitoring device 210 connects conductors 212 and 214 and has been arranged to produce a voltage between the conductors. As the electrically insulating polymer coating is wearing off, its insulating capacity is reduced. Finally, the electrically conductive parts inside the rope come into contact with the pulley 211, the circuit between the conductors 214 and 212 being thus closed. The condition monitoring device 210 further comprises means for observing an electric property of the circuit formed by the conductors 212 and 214, the rope 213 and the pulley 211. These means may comprise e.g. a sensor and a processor, which, upon detecting a change in the electric property, activate an alarm about excessive rope wear. The electric property to be observed may be, e.g. a change in the electric current flowing through the aforesaid circuit or in the resistance, or a change in the magnetic field or voltage.

Figure 6:
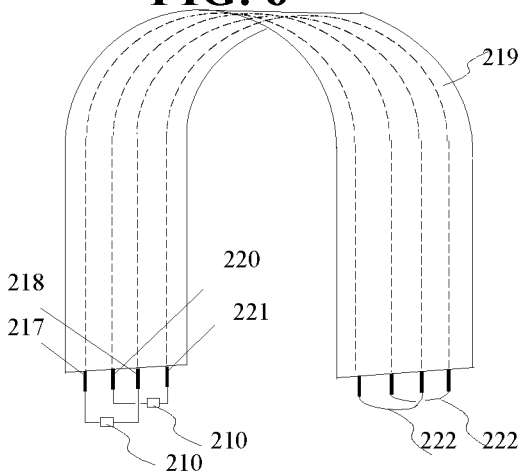
FIG. 6 is a diagrammatic representation of an embodiment of the elevator of the invention comprising a condition monitoring arrangement.

FIG. 6 is a diagrammatic representation of an embodiment of the elevator of the invention provided with a condition monitoring arrangement for monitoring the condition of the rope 219, particularly for monitoring the condition of the load-bearing part. The rope 219 is preferably of one of the types described above and comprises at least one electrically conductive part 217, 218, 220, 221, preferably a part containing carbon fiber. The condition monitoring arrangement comprises a condition monitoring device 210 connected to the electrically conductive part of the rope, which preferably is a load-bearing part. The condition monitoring device 210 comprises means, such as e.g. a voltage or current source for transmitting an excitation signal into the load-bearing part of the rope 219 and means for detecting, from another point of the load-bearing part or from a part connected to it, a response signal responding to the transmitted signal. On the basis of the response signal, preferably by comparing it to predetermined limit values by means of a processor, the condition monitoring device has been arranged to infer the condition of the load-bearing part in the area between the point of input of the excitation signal and the point of measurement of the response signal. The condition monitoring device has been arranged to activate an alarm if the response signal does not fall within a desired range of values. The response signal changes when a change occurs in an electric property dependent on the condition of the load-bearing part of the rope, such as resistance or capacitance. For example, resistance increasing due to cracks will produce a change in the response signal, from which change it can be deduced that the load-bearing part is in a weak condition. Preferably, this is arranged as illustrated in FIG. 6 by having the condition monitoring device 210 placed at a first end of the rope 219 and connected to two load-bearing parts 217 and 218, which are connected at the second end of the rope 219 by conductors 222. With this arrangement, the condition of both parts 217, 218 can be monitored simultaneously. When there are several objects to be monitored, the disturbance caused by mutually adjacent load-bearing parts to each other can be reduced by interconnecting non-adjacent load-bearing parts with conductors 222, preferably connecting every second part to each other and to the condition monitoring device 210.

Figure 7:
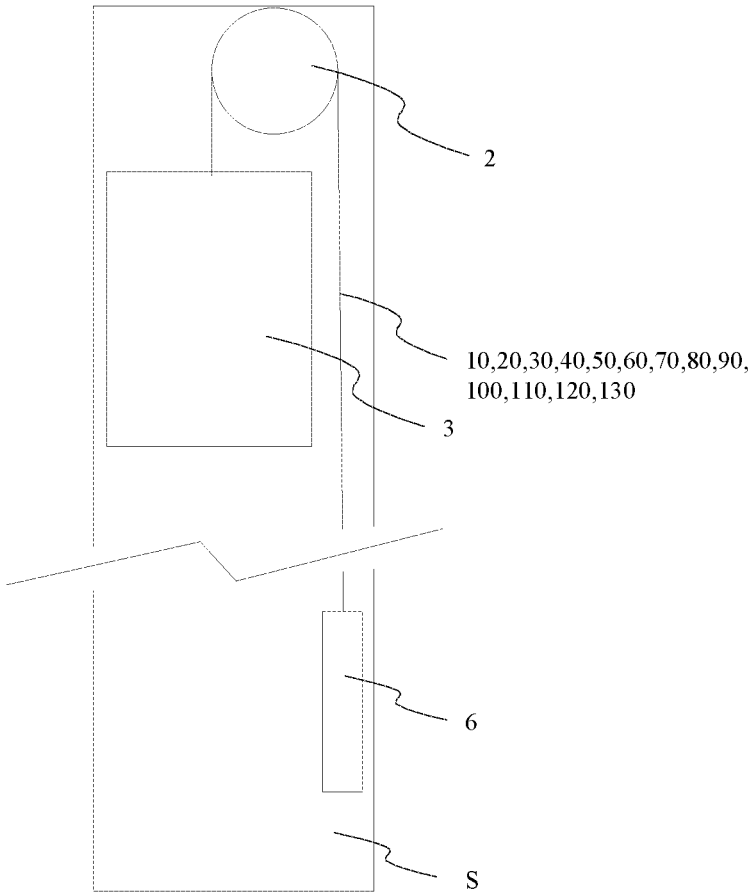
FIG. 7 is a diagrammatic representation of an embodiment of the elevator of the invention.

FIG. 7 presents an embodiment of the elevator of the invention wherein the elevator rope system comprises one or more ropes 10, 20, 30, 40, 50, 60, 70, 80, 90, 100, 110, 120, 130. The first end of the rope 10, 20, 30, 40, 50, 60, 70, 80, 90, 100, 110, 120, 130, 8 is secured to the elevator car 3 and the second end to the counterweight 6. The rope is moved by means of a drive sheave 2 supported on the building. The drive sheave is connected to a power source, such as, e.g. an electric motor (not shown), imparting rotation to the drive sheave. The rope is preferably of a construction as illustrated in one of FIGS. 1*a*-1*m*. The elevator is preferably a passenger elevator, which has been installed to travel in an elevator shaft S in the building. The elevator presented in FIG. 7 can be utilized with certain modifications for different hoisting heights.

An advantageous hoisting height range for the elevator presented in FIG. 7 is over 100 meters, preferably over 150 meters, and still more preferably over 250 meters. In elevators of this order of hoisting heights, the rope masses already have a very great importance regarding energy efficiency and structures of the elevator. Consequently, the use of a rope according to the invention for moving the elevator car 3 of a high-rise elevator is particularly advantageous, because in elevators designed for large hoisting heights the rope masses have a particularly great effect. Thus, it is possible to achieve, inter alia, a high-rise elevator having a reduced energy consumption. When the hoisting height range for the elevator in FIG. 7 is over 100 meters, it is preferable, but not strictly necessary, to provide the elevator with a compensating rope.

The ropes described are also well applicable for use in counterweighted elevators, e.g. passenger elevators in residential buildings, that have a hoisting height of over 30 m. In the case of such hoisting heights, compensating ropes have traditionally been necessary. The present invention allows the mass of compensating ropes to be reduced or even eliminated altogether. In this respect, the ropes described here are even better applicable for use in elevators having a hoisting height of 30-80 meters, because in these elevators the need for a compensating rope can even be eliminated altogether. However, the hoisting height is most preferably over 40 m, because in the case of such heights the need for a compensating rope is most critical, and below 80 m, in which height range, by using low-weight ropes, the elevator can, if desirable, still be implemented even without using compensating ropes at all. FIG. 7 depicts only one rope, but preferably the counterweight and elevator car are connected together by a number of ropes.

In the present application, 'load-bearing part' refers to a rope element that carries a significant proportion of the load imposed on the rope in its longitudinal direction, e.g. of the load imposed on the rope by an elevator car and/or counterweight supported by the rope. The load produces in the load-bearing part a tension in the longitudinal direction of the rope, which tension is transmitted further in the longitudinal direction of the rope inside the load-bearing part in question. Thus, the load-bearing part can, e.g. transmit the longitudinal force imposed on the rope by the drive sheave to the counterweight and/or elevator car in order to move them. For example in FIG. 7, where the counterweight 6 and elevator car 3 are supported by the rope (10, 20, 30, 40, 50, 60, 70, 80, 90, 100, 110, 120, 130), more precisely speaking by the load-bearing part in the rope, which load-bearing part extends from the elevator car 3 to the counterweight 6. The rope (20, 30, 40, 50, 60, 70, 80, 90, 100, 110, 120, 130) is secured to the counterweight and to the elevator car. The tension produced by the weight of the counterweight/elevator car is transmitted from the securing point via the load-bearing part of the rope (10, 20, 30, 40, 50, 60, 70, 80, 90, 100, 110, 120, 130) upwards from the counterweight/elevator car at least up to the drive sheave 2.

As mentioned above, the reinforcing fibers of the load-bearing part in the rope (10, 20, 30, 40, 50, 60, 70, 80, 90, 100, 110, 120, 130, 8, A, B) of the invention for a hoisting device, especially a rope for a passenger elevator, are preferably continuous fibers. Thus the fibers are preferably long fibers, most preferably extending throughout the entire length of the rope. Therefore, the rope can be produced by coiling the reinforcing fibers from a continuous fiber tow, into which a polymer matrix is absorbed. Substantially all of the reinforcing fibers of the load-bearing part (11, 21, 31, 41, 51, 61, 71, 81, 91, 101, 121) are preferably made of one and the same material.

As explained above, the reinforcing fibers in the load-bearing part (11, 21, 31, 41, 51, 61, 71, 81, 91, 101, 111, 121) are in a polymer matrix. This means that, in the invention, individual reinforcing fibers are bound together by a polymer matrix, e.g. by immersing them during manufacture into polymer matrix material. Therefore, individual reinforcing fibers bound together by the polymer matrix have between them some polymer of the matrix. In the invention, a large quantity of reinforcing fibers bound together and extending in the longitudinal direction of the rope are distributed in the polymer matrix. The reinforcing fibers are preferably distributed substantially uniformly, i.e. homogeneously in the polymer matrix, so that the load-bearing part is as homogeneous as possible as observed in the direction of the cross-section of the rope. In other words, the fiber density in the cross-section of the load-bearing part thus does not vary greatly. The reinforcing fibers together with the matrix constitute a load-bearing part, inside which no chafing relative motion takes place when the rope is being bent. In the invention, individual reinforcing fibers in the load-bearing part (11, 21, 31, 41, 51, 61, 71, 81, 91, 101, 111, 121, 131) are mainly surrounded by the polymer matrix, but fiber-fiber contacts may occur here and there because it is difficult to control the positions of individual fibers relative to each other during their simultaneous impregnation with polymer matrix, and, on the other hand, complete elimination of incidental fiber-fiber contacts is not an absolute necessity regarding the functionality of the invention. However, if their incidental occurrences are to be reduced, then it is possible to pre-coat individual reinforcing fibers so that they already have a polymer coating around them before the individual reinforcing fibers are bound together.

In the invention, individual reinforcing fibers of the load-bearing part (11, 21, 31, 41, 51, 61, 71, 81, 91, 101, 111, 121, 131) comprise polymer matrix material around them. The polymer matrix is thus placed immediately against the reinforcing fiber, although between them there may be a thin coating on the reinforcing fiber, e.g. a primer arranged on the surface of the reinforcing fiber during production to improve chemical adhesion to the matrix material. Individual reinforcing fibers are uniformly distributed in the load-bearing part (11, 21, 31, 41, 51, 61, 71, 81, 91, 101, 111, 121, 131) so that individual reinforcing fibers have some matrix polymer between them. Preferably most of the spaces between individual reinforcing fibers in the load-bearing part are filled with matrix polymer. Most preferably substantially all of the spaces between individual reinforcing fibers in the load-bearing part are filled with matrix polymer. In the inter-fiber areas there may appear pores, but it is preferable to minimize the number of these.

The matrix of the load-bearing part (11, 21, 31, 41, 51, 61, 71, 81, 91, 101, 111, 121, 131) most preferably has hard material properties. A hard matrix helps support the reinforcing fibers especially when the rope is being bent. At bending, the reinforcing fibers closest to the outer surface of the bent rope are subjected to tension whereas the carbon fibers closest to the inner surface are subjected to compression in their lengthwise direction. Compression tends to cause the reinforcing fibers to buckle. By selecting a hard material for the polymer matrix, it is possible to prevent buckling of fibers, because a hard material can provide support for the fibers and thus prevent them from buckling and equalize tensions within the rope. Thus it is preferable, inter alia to permit reduction of the bending radius of the rope, to use a polymer matrix consisting of a polymer that is hard, preferably other than an elastomer (an example of an elastomer: rubber) or similar elastically behaving or yielding material. The most preferable materials are epoxy, polyester, phenolic plastic or vinyl ester. The polymer matrix is preferably so hard that its coefficient of elasticity (E) is over 2 GPa, most preferably over 2.5 GPa. In this case, the coefficient of elasticity is preferably in the range of 2.5-10 GPa, most preferably in the range of 2.5-3.5 GPa.

Figure 8:
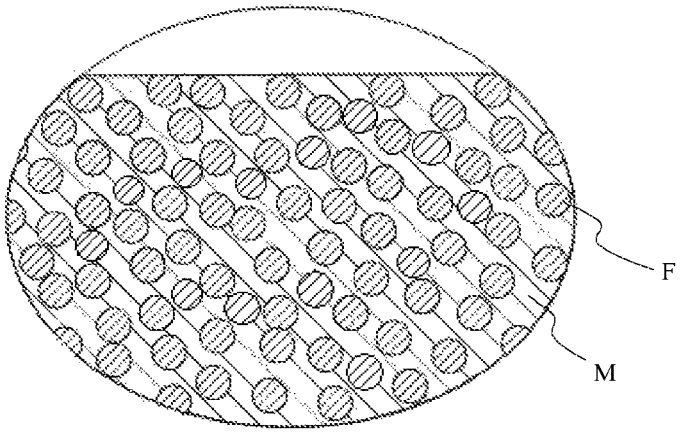
FIG. 8 is a magnified diagrammatic representation of a detail of the cross-section of the rope of the invention.

FIG. 8 presents within a circle a partial cross-section of the surface structure of the load-bearing part (as seen in the lengthwise direction of the rope), this cross-section showing the manner in which the reinforcing fibers in the load-bearing parts (11, 21, 31, 41, 51, 61, 71, 81, 91, 101, 111, 121, 131) described elsewhere in the application are preferably arranged in the polymer matrix. The figure shows how the reinforcing fibers F are distributed substantially uniformly in the polymer matrix M, which surrounds the fibers and adheres to the fibers. The polymer matrix M fills the spaces between reinforcing fibers F and, consisting of coherent solid material, binds substantially all reinforcing fibers F in the matrix together. This prevents mutual chafing between reinforcing fibers F and chafing between matrix M and reinforcing fibers F. Between individual reinforcing fibers, preferably all the reinforcing fibers F and the matrix M there is a chemical bond, which provides the advantage of structural coherence, among other things. To strengthen the chemical bond, it is possible, but not necessary, to provide a coating (not shown) between the reinforcing fibers and the polymer matrix M. The polymer matrix M is as described elsewhere in the application and may comprise, besides a basic polymer, additives for fine adjustment of the matrix properties. The polymer matrix M preferably consists of a hard elastomer.

In the method of using according to the invention, a rope as described in connection with one of FIGS. 1*a*-1*m* is used as the hoisting rope of an elevator, particularly a passenger elevator. One of the advantages achieved is an improved energy efficiency of the elevator. In the method of using according to the invention, at least one rope, but preferably a number of ropes of a construction such that the width of the rope is larger than its thickness in a transverse direction of the rope are fitted to support and move an elevator car, said rope comprising a load-bearing part (11, 21, 31, 41, 51, 61, 71, 81, 91, 101, 111, 121, 131) made of a composite material, which composite material comprises reinforcing fibers, which consist of carbon fiber or glass fiber, in a polymer matrix. The hoisting rope is most preferably secured by one end to the elevator car and by the other end to a counterweight in the manner described in connection with FIG. 7, but it is applicable for use in elevators without counterweight as well. Although the figures only show elevators with a 1:1 hoisting ratio, the rope described is also applicable for use as a hoisting rope in an elevator with a 1:2 hoisting ratio. The rope (10, 20, 30, 40, 50, 60, 70, 80, 90, 100, 110, 120, 130, 8, A, B) is particularly well suited for use as a hoisting rope in an elevator having a large hoisting height, preferably an elevator having a hoisting height of over 100 meters. The rope defined can also be used to implement a new elevator without a compensating rope, or to convert an old elevator into one without a compensating rope. The proposed rope (10, 20, 30, 40, 50, 60, 70, 80, 90, 100, 110, 120, 130, 8, A, B) is well applicable for use in an elevator having a hoisting height of over 30 meters, preferably 30-80 meters, most preferably 40-80 meters, and implemented without a compensating rope. 'Implemented without a compensating rope' means that the counterweight and elevator car are not connected by a compensating rope. Still, even though there is no such specific compensating rope, it is possible that a car cable attached to the elevator car and especially arranged to be hanging between the elevator shaft and elevator car may participate in the compensation of the imbalance of the car rope masses. In the case of an elevator without a compensating rope, it is advantageous to provide the counterweight with means arranged to engage the counterweight guide rails in a counterweight bounce situation, which bounce situation can be detected by bounce monitoring means, e.g. from a decrease in the tension of the rope supporting the counterweight.

It is obvious that the cross-sections described in the present application can also be utilized in ropes in which the composite has been replaced with some other material, such as e.g. metal. It is likewise obvious that a rope comprising a straight composite load-bearing part may have some other cross-sectional shape than those described, e.g. a round or oval shape.

The advantages of the invention will be the more pronounced, the greater the hoisting height of the elevator. By utilizing ropes according to the invention, it is possible to achieve a mega-high-rise elevator having a hoisting height even as large as about 500 meters. Implementing hoisting heights of this order with prior-art ropes has been practically impossible or at least economically unreasonable. For example, if prior-art ropes in which the load-bearing part comprises metal braidings were used, the hoisting ropes would weigh up to tens of thousands of kilograms. Consequently, the mass of the hoisting ropes would be considerably greater than the payload.

The invention has been described in the application from different points of view. Although substantially the same invention can be defined in different ways, entities defined by definitions starting from different points of view may slightly differ from each other and thus constitute separate inventions independently of each other.

It is obvious to one having ordinary skill in the art that the invention is not exclusively limited to the embodiments described above, in which the invention has been described by way of example, but that many variations and different embodiments of the invention are possible within the scope of the inventive concept defined in the claims presented below. Thus it is obvious that the ropes described may be provided with a cogged surface or some other type of patterned surface to produce a positive contact with the drive sheave. It is also obvious that the rectangular composite parts presented in FIGS. 1*a*-1*m* may comprise edges more starkly rounded than those illustrated or edges not rounded at all. Similarly, the polymer layer 1 of the ropes may comprise edges/corners more starkly rounded than those illustrated or edges/corners not rounded at all. It is likewise obvious that the load-bearing part/parts (11, 21, 31, 41, 51, 61, 71, 81, 91) in the embodiments in FIGS. 1*a*-1*j* can be arranged to cover most of the cross-section of the rope. In this case, the sheath-like polymer layer 1 surrounding the load-bearing part/parts is made thinner as compared to the thickness of the load-bearing part in the thickness-wise direction t1 of the rope. It is likewise obvious that, in conjunction with the solutions represented by FIGS. 2, 3 and 4, it is possible to use belts of other types than those presented. It is likewise obvious that both carbon fiber and glass fiber can be used in the same composite part, if necessary. It is likewise obvious that the thickness of the polymer layer may be different from that described. It is likewise obvious that the shear-resistant part could be used as an additional component with any other rope structure showed in this application. It is likewise obvious that the matrix polymer in which the reinforcing fibers are distributed may comprise—mixed in the basic matrix polymer, such as e.g. epoxy—auxiliary materials, such as e.g. reinforcements, fillers, colors, fire retardants, stabilizers or corresponding agents. It is likewise obvious that, although the polymer matrix preferably does not consist of elastomer, the invention can also be utilized using an elastomer matrix. It is also obvious that the fibers need not necessarily be round in cross-section, but they may have some other cross-sectional shape. It is further obvious that auxiliary materials, such as, e.g. reinforcements, fillers, colors, fire retardants, stabilizers or corresponding agents, may be mixed in the basic polymer of the layer 1, e.g. in polyurethane. It is likewise obvious that the invention can also be applied in elevators designed for hoisting heights other than those considered above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A hoisting rope for an elevator, said hoisting rope having a width larger than a thickness thereof in a transverse direction of the hoisting rope, said hoisting rope comprising one or more load-bearing parts made of a composite material, said composite material comprising reinforcing fibers in a polymer matrix, said reinforcing fibers including carbon fiber or glass fiber, wherein each load-bearing part consists of the polymer matrix, the reinforcing fibers bound together by the polymer matrix, a coating provided around the reinforcing fibers, and one or more auxiliary materials including a fire retardant within the polymer matrix, and wherein said reinforcing fibers are substantially mutually non-entangled and parallel to a lengthwise direction of the hoisting rope.

2. The hoisting rope according to claim 1, wherein, when there are more than one load-bearing parts, the more than one load-bearing parts are spaced from each other.

3. The hoisting rope according to claim 1, wherein individual fibers of the reinforcing fibers are evenly distributed in said polymer matrix.

4. The hoisting rope according to claim 1, wherein said reinforcing fibers are bound together as an integral load-bearing part by said polymer matrix.

5. The hoisting rope according to claim 1, wherein each load-bearing part consists of straight reinforcing fibers parallel to a lengthwise direction of the hoisting rope and bound together by the polymer matrix to form an integral element.

6. The hoisting rope according to claim 1, wherein, each load-bearing part is an integral elongated body.

7. The hoisting rope according to claim 1, wherein said coating is a primer to improve chemical adhesion between the reinforcing fibers and the polymer matrix.

8. The hoisting rope according to claim 1, wherein a structure of the hoisting rope continues as a substantially uniform structure throughout a length of the hoisting rope.

9. The hoisting rope according to claim 1, wherein a structure of each load-bearing part continues as a substantially uniform structure throughout a length of the hoisting rope.

10. The hoisting rope according to claim 1, wherein the polymer matrix consists of non-elastomeric material.

11. The hoisting rope according to claim 1, wherein a coefficient of elasticity (E) of the polymer matrix (M) is over 2 GPa.

12. The hoisting rope according to claim 1, wherein the polymer matrix comprises epoxy, polyester, phenolic plastic or vinyl ester.

13. The hoisting rope according to claim 1, wherein over 50% of a cross-sectional square area of each load-bearing part consists of said reinforcing fiber.

14. The hoisting rope according to claim 1, wherein the reinforcing fibers together with the polymer matrix form an integral load-bearing part, inside which substantially no chafing relative motion between fibers or between fibers and matrix takes place.

15. The hoisting rope according to claim 1, wherein a width of each load-bearing part is larger than a thickness thereof in a transverse direction of the hoisting rope.

16. The hoisting rope according to claim 1, wherein the hoisting rope comprises a plurality of load-bearing parts placed mutually adjacently.

17. The hoisting rope according to claim 1, wherein the hoisting rope further comprises outside the composite material at least one metallic element in the form of a wire, a lath or a metallic grid.

18. The hoisting rope according to claim 1, wherein each load-bearing part is surrounded by a polymer layer comprising an elastomer.

19. The hoisting rope according to claim 1, wherein the one or more load-bearing parts comprises a main proportion of a cross-section of the hoisting rope.

20. The hoisting rope according to claim 1, wherein a structure of the hoisting rope continues as a substantially uniform structure throughout a length of the hoisting rope, and wherein the hoisting rope comprises a broad surface that is substantially even so as to enable friction-based force-transmitting via the broad surface.

21. The hoisting rope according to claim 1, wherein each load-bearing part covers an entire cross-section of the hoisting rope.

22. The hoisting rope according to claim 1, wherein the hoisting rope comprises protrusions or grooves for guiding the hoisting rope.

23. The hoisting rope according to claim 1, wherein the hoisting rope is provided with a cogged surface to produce a positive contact with a drive sheave.

24. The hoisting rope according to claim 1, wherein the hoisting rope is symmetrical in a thickness direction thereof.

25. The elevator according to claim 24, wherein a hoisting height of the elevator is over 75 meters.

26. The hoisting rope according to claim 1, wherein the coating is a primer arranged on the surface of the reinforcing fibers.

27. An elevator comprising:

a drive sheave;

a power source for rotating the drive sheave;

an elevator car; and a rope system for moving the elevator car by means of the drive sheave, said rope system comprising at least one hoisting rope, said at least one hoisting rope having a width larger than a thickness thereof in a transverse direction of the at least one hoisting rope, said hoisting rope comprising:

one or more load-bearing parts made of a composite material, said composite material comprising reinforcing fibers in a polymer matrix, said reinforcing fibers including carbon fiber or glass fiber, wherein each load-bearing part consists of the polymer matrix, the reinforcing fibers bound together by the polymer matrix, a coating provided around the reinforcing fibers, and one or more auxiliary materials including a fire retardant within the polymer matrix, and wherein said reinforcing fibers are substantially mutually non-entangled and parallel to a lengthwise direction of the hoisting rope.

28. The elevator according to claim 27, wherein said at least one hoisting rope comprises a plurality of hoisting ropes, each of which is fitted side by side against a circumference of the drive sheave.

29. The elevator according to claim 27, wherein the hoisting rope passes around a first diverting pulley, on which the hoisting rope is bent in a first bending direction, after which the hoisting rope passes around a second diverting pulley, on which the hoisting rope is bent in a second bending direction, this second bending direction being substantially opposite to the first bending direction.

30. The elevator according to claim 27, wherein the elevator is implemented without a compensating rope.

* * * * *